US005899452A

United States Patent [19]

Walsh

[11] Patent Number: 5,899,452

[45] Date of Patent: May 4, 1999

[54] STACKER MECHANISM FOR STACKING BANK NOTES

[75] Inventor: Michael Walsh, East Patchogue, N.Y.

[73] Assignee: Coin Bill Validator, Inc., Hauppauge, N.Y.

[21] Appl. No.: 08/685,372

[22] Filed: Jul. 23, 1996

[51] Int. Cl.[6] ..... B65H 29/44

[52] U.S. Cl. ..... 271/180

[58] Field of Search ..... 271/180, 181

[56] References Cited

FOREIGN PATENT DOCUMENTS 188338 8/1986 Japan ..... 271/181

186126 7/1993 Japan ..... 271/180

19269 9/1994 WIPO ..... 271/180

*Primary Examiner*—Boris Milef

*Attorney, Agent, or Firm*—Bauer & Schaffer

[57] ABSTRACT

A crank assembly has a rotary motor mounted on the top of the trough forming the storage unit in a stacker, the drive shaft of the motor extends parallel to the pathway in which the bank note moves from the acceptor. A first crank member is centrally secured to the drive shaft for rotary motion and a second crank member is freely journalled to the first crank member and to the presser plate at each end, for revolutionary movement in a vertical plane to the pathway. A pair of spaced columns are fixedly attached to the top surface of the presser plate

6 Claims, 3 Drawing Sheets

Fig. 2
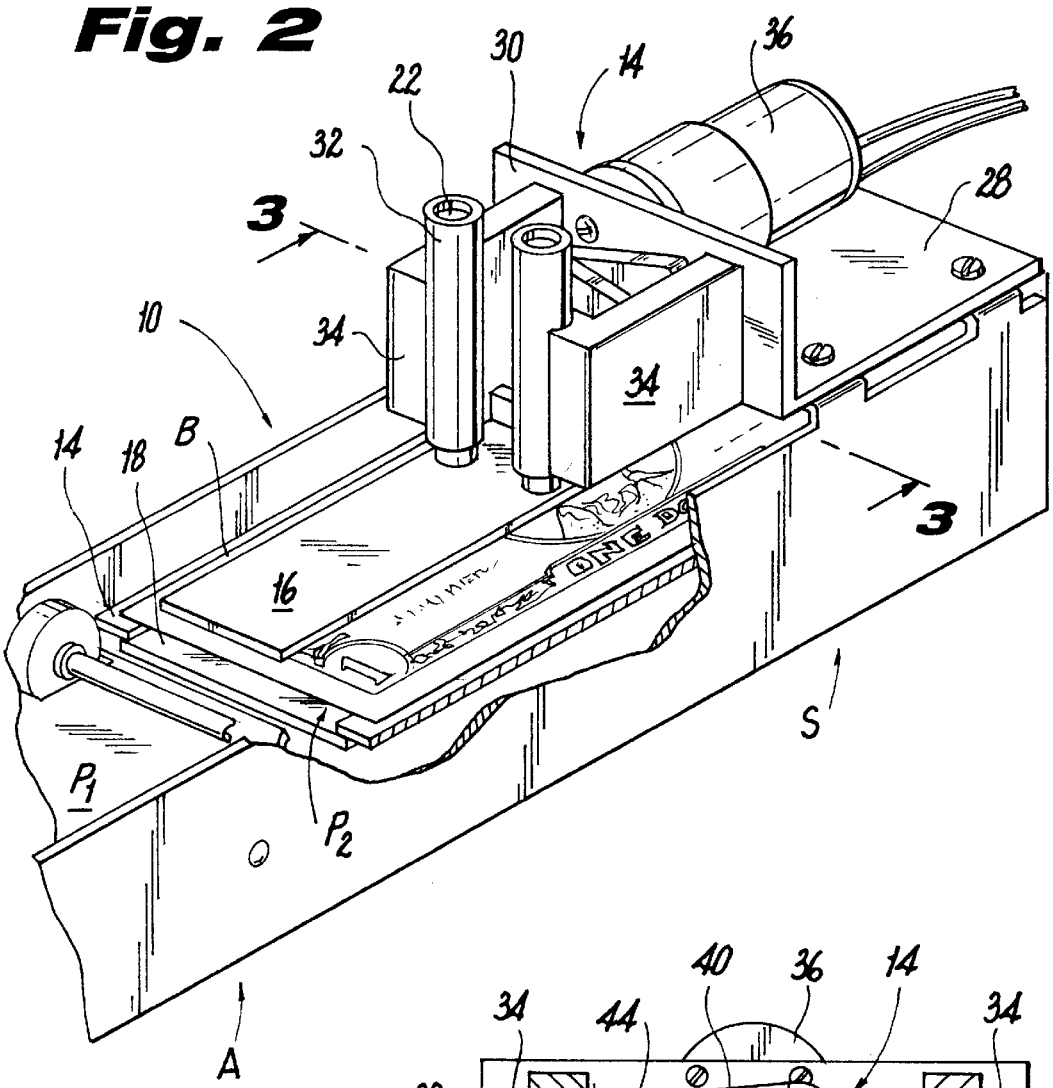
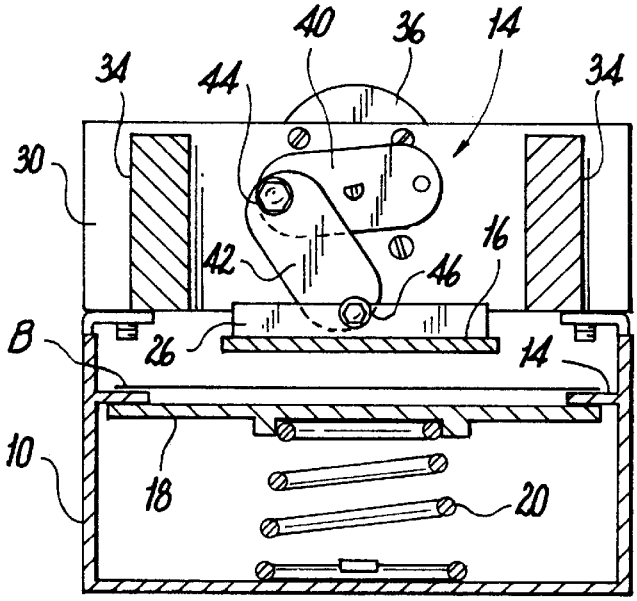
Fig. 3

STACKER MECHANISM FOR STACKING BANK NOTES

BACKGROUND OF THE INVENTION

The present invention relates to a stacking mechanism for the storage assembly of bank notes in a bank note validator.

Bank note validators generally consist of an arrangement of devices for automatically recognizing, accepting and accumulating not only currency, but also coupons, documents or other valuable paper. In such devices, once the bank note is validated it is stored until a sufficient number of such bills are accumulated for removal. Reference can be made to U.S. Pat. Nos. 5,322,275; 4,884,671; 4,011,931; 4,418,824 and 4,678,072.

As will be seen from the prior devices the bank note is generally moved in a linear direction over a flat table, in order for it to be electronically and optically sensed for validity. Once accepted as being valid, the bank note is fed on to a pair of horizontally spaced rails from which it's pushed perpendicularly for stacking one on the other in a storage container. The pushing devices have employed elaborate mechanisms to translate the movement of the bank note, and are generally referred to as "stackers". The stacker converts a rotary motion to the linear motion which is then transmitted to the pusher plate. The known transmission mechanisms use scissor type platforms, eccentric cams, springs, bushings and the like, all having an excess of complexity and thus, greatly reduced reliability.

Another problem found in the known stackers lies in the fact that they have severe limitations when handling bank notes of various countries since some countries employ wide notes and some employ narrow notes. Since the throw or stroke of the stacker is directly proportioned to the size of the bank note, and the stroke must be increased for the wider notes and decreased for the narrower notes, to permit the bank not to easily pass over the rails without folding or misaligning in the storage area.

It is the object of the present invention to provide a bank note stacker mechanism for validators which overcomes the defects and deficiencies of the prior devices.

It is another object of the present invention to provide a stacker mechanism which is simple, has few parts and which is more reliable.

It is a object further of the present invention to provide a stacker mechanism capable of adjustment to the width of the bank note, so as to enable the validator apparatus to have a more universal use.

The foregoing objects together with other objects and advantages of the present invention will become obvious to those skilled in the art upon contemplation of the following disclosure

SUMMARY OF THE INVENTION

According to the present invention, the stacking mechanism is provided with a crank assembly having a rotary motor mounted on the top of the trough forming the storage unit, the drive shaft of which extends parallel to the pathway in which the bank note moves from the acceptor. A first crank member is centrally secured to the drive shaft for rotary motion and a second crank member is freely journalled to the first crank member and to the presser plate at each end, for revolutionary movement in a vertical plane to the pathway. Preferably, the rotary motion is unidirectional so that its motion is translated into reciprocating action of the presser plate without reversal of the motor or the crank member.

To ensure stable up and down movement of the presser plate, a pair of spaced columns are fixedly attached to the top surface of the presser plate. The columns are preferably made of low friction plastic or aluminum Each column slidingly by fits within a sleeve fixed to the top of the trough in telescoping fashion. Thus, as the presser plate moves up and down, the columns maintain stability within their sleeves.

Full details of the present invention are set forth in the following description and in the accompanying drawings.

BRIEF DESCRIPTION OF THE DRAWINGS

FIG. 2 is an assembled view of the device shown in FIG. 1.

FIG. 3 is a sectional view of the stacker of the present invention taken along line 3—3 of FIG. 2.

DESCRIPTION OF THE INVENTION

Figure 1:
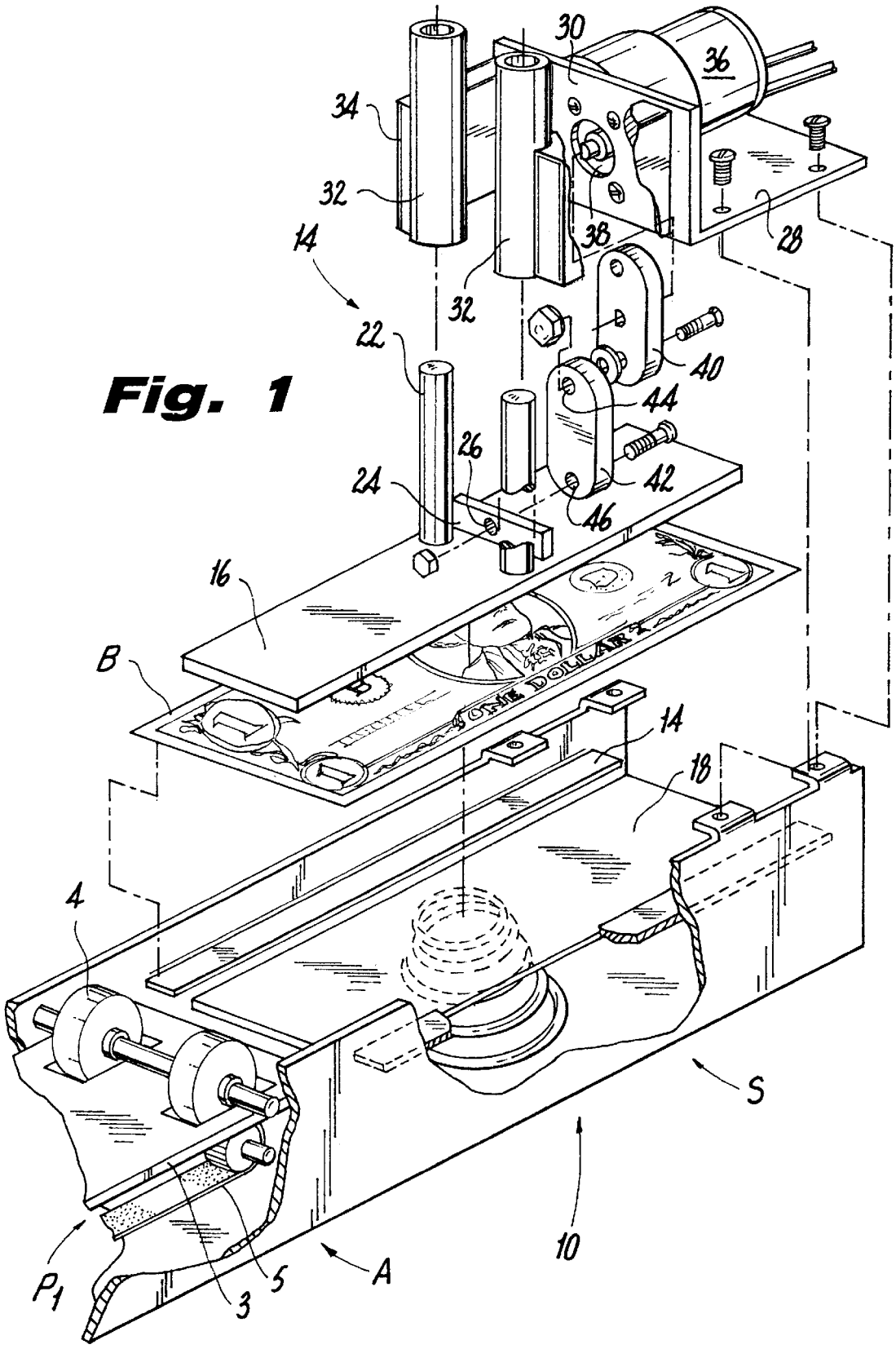
FIG. 1 is an exploded view of stacker and storage sections of a bank note validator embodying the present invention

The present invention is applied to the structure of the acceptor and storage sections of the validator disclosed in the heretofore mentioned patents and particularly, to the validators shown in aforementioned U.S. Pat. Nos. 4,884,671 and 5,322,275. Only those details necessary for understanding the invention are shown in the accompanying figures and should any further details be required, reference to these patents may be made, and the patents are incorporated herein as if more fully set forth.

As seen in the drawings, the bank note accumulating storage unit generally designated by the letter "S", annexed to the bank note acceptor section, generally designated by the letter A. Only so much of the acceptor A, as is needed to explain the present invention, will be described herein. As seen in the acceptor A is aligned with the storage unit S so that a bill B in the acceptor can be transported through a planar pathway-P1 defined by an upper plate 2 and a lower plate 3, by a roller 4 and belt 5 conveyer across a gap into the mouth of a similar pathway P2 in the storage units.

The storage unit S comprises a U-shaped trough-like housing 10, comprising sides and a bottom Extending inwardly from each side is a narrow rail 14 defining the lower wall of the pathway P2 on which the bank note B fed from the acceptor, and on which it comes to rest. Above the pathway P2 is located a pusher assembly generally defined by the numeral 140 The pusher assembly comprises a free floating presser plate 16 oriented substantially parallel to the planar surfaces of the bank note and to the pathway P2. Below the pathway P2 is a moveable paper currency stacking support platform 18 supported by one or more lightweight compression springs 20, the area between the platform 18 and the lower surface of the rail 14 defining the paper storage area.

In accordance with the present invention, mounted on the upper surface of the presser plate 16 is a pair of parallel spaced cylindrical columns 22. The columns are solid, preferably of low friction plastic such as nylon, or highly polished aluminum or steel and are permanently secured to the presser plate. The columns have a height substantially greater than the desired stroke of the presser plate. Also, securely fixed to the surface of the presser plate and slightly to the rear of the columns 22 is a mounting bloc 24. The bloc extends transversely to the long axis of the presser plate 16 and is provided with a hole 26 midway of its ends.

On the upper edges of the trough-like housing, is fixedly mounted an L-shaped support plate 28. The vertical leg 30 of the L-shaped support defines a wall facing the columns on which is mounted a pair of hollow cylindrical sleeves 32. The sleeves 32 are welded to forwardly extending retaining brackets 34 which themselves are welded to the vertical wall so that the sleeves are co-axially aligned respectively with the columns 22 and provide a slidable support therefor. Mounted on the L-shaped support plate 30 to the rear of the vertical wall is a small unidirectional electric motor 36, the drive shaft of which extends through a hole 38 in the vertical wall in alignment with the central axis of the presser plate 16.

The drive shaft of the motor 36 is linked to the presser plate 16 by a rotary and revolving crank system which converts the rotary motion of the motor to linear reciprocal motion in the vertical direction. The crank system comprises a first oblong link 40 secured at its center to the drive shaft and a second oblong link 42 freely journaled at one end 44 to an end of the first link 40 and freely journalled at its other end 46 to the transverse mounting bloc 24, by a bolt 48 passing through the hole 26.

Figure 4:
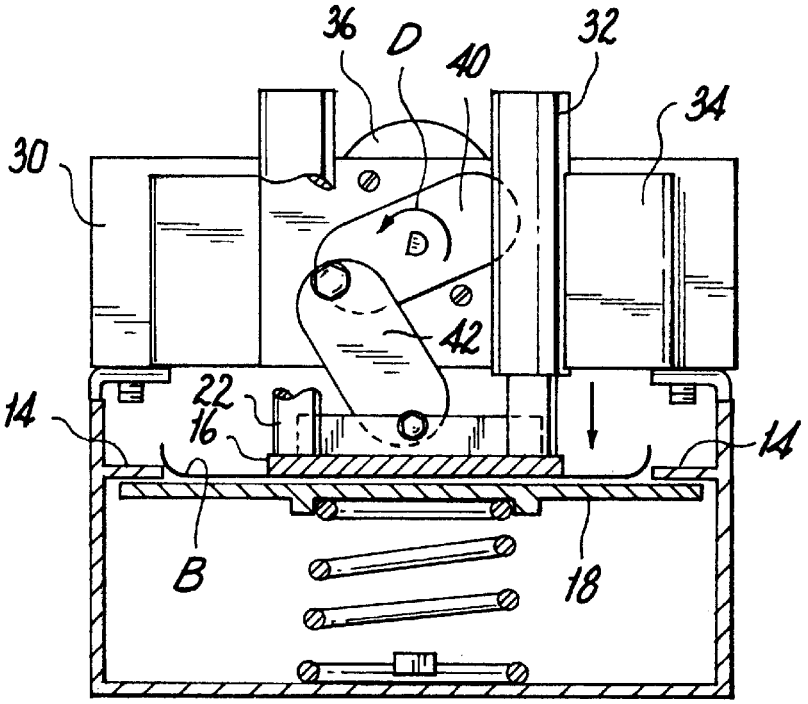
FIGS. 4 and 5 are sectional views similar to FIG. 3 showing various stages in the operation of the stacker mechanism.
Figure 5:
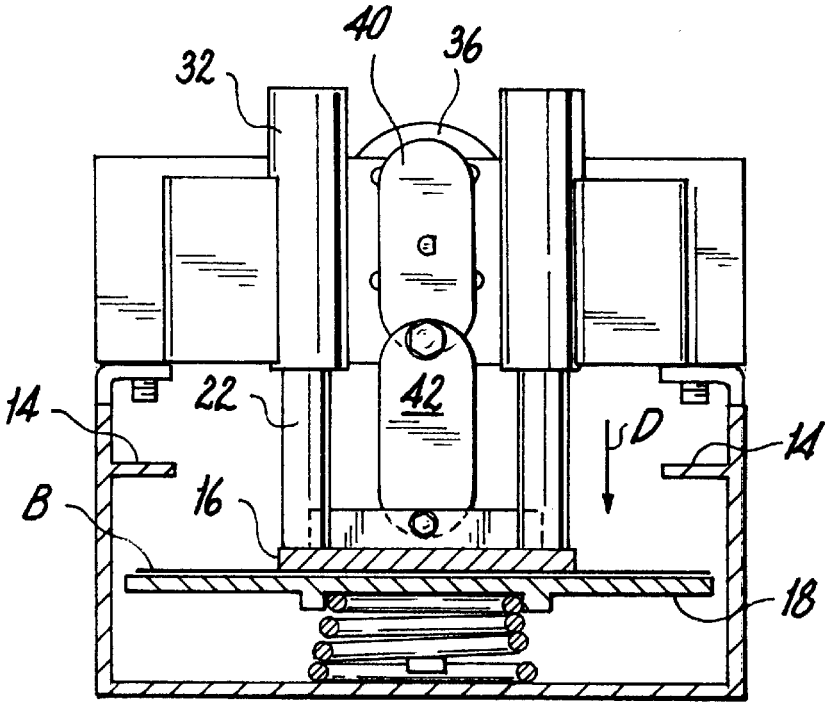

As seen from FIGS. 3–5, rotation of the motor drive shaft in the counter clockwise direction, illustrated by arrow D, will cause the presser plate 16 to be reciprocally moved; FIG. 3 illustrating the upper most or rest position of the presser plate 16, (leaving the pathway P2 free to receive the bank note); FIG. 4 illustrating the intermediate position where the presser plate 16 is depressed against the bank note B, causing it to curl over the rails 14; and FIG. 5 illustrating the final position where the presser plate 16 is at its full downward stroke, and the bank note B and the support platform 18 are fully depressed into the storage unit. From the position shown in FIG. 5, further rotation of the motor in the direction D, will cause the crank to continue its counter clockwise motion first flexing or buckling opposite to that seen in FIG. 4, raising the presser plate 16 and then coming to its upward rest position (FIG. 3).

The pusher plate 16 can be changed quite easily to accommodate differently sized bank notes, since the pusher plate 16 is held by only bolt 48 which is easily available to manual manipulation. Thus, the present invention introduces a reliable, simple pusher for a stacking mechanism designed specifically to address the multi width bank note requirements of international stacking mechanisms. Also, by either exchanging the links 40 and 42 with others of a different size, or by journalling the links at different points, the stroke of the presser plate can be varied. Thus, the design overcomes pusher stroke limitations vs. width limitations The disclosure shows a split linked crank mechanism The crank employs two equal length arms (but may be different lengths), to minimize the overall space requirements, while maximizing stroke length. Long strokes are possible with narrow pushers.

The invention eliminates the extreme precision of the pusher guides while improving reliability and minimizing the possibility of jamming, by locating the pusher force in the ,enter of the trough eliminating twisting and jamming.

The columnar guides (22 and 32) consist of piston like assemblies, cylindrically shaped, (other shapes may be used), to minimize precision fit requirements. A maximum of guide surface area is possible from the entire circumference of the cylindrical guide surface area and may be telescoping to provide even greater stroke length in even smaller spaces Various modifications and changes have been disclosed herein, and others will be apparent to those skilled in this art. Therefore, it is to be understood that the present disclosure is by way of illustration and not limiting of the present invention.

What is claimed is:

1. A stacking mechanism for a storage unit paper bank note validator and acceptor apparatus comprising: trough-shaped housing having a pathway therein adapted to receive bills of paper currency from the paper bank note acceptor apparatus; a spring biased platform located in said housing below the pathway oriented parallel to the planar surfaces of the currency in the pathway so as to define a variable volume storage area within said housing between said platform and the pathway; a presser plate oriented parallel to said platform, above the pathway, said presser plate being reversibly moveable from a starting position above the pathway opposite said platform to a depressed position abutting said platform within said storage area; and a crank assembly for moving said presser plate comprising a rotary motor mounted on an upper edge of said housing having a drive shaft extending parallel to the plane of the pathway, and crank means connected to said drive shaft and depending directly to said presser plate for reciprocally moving said presser plate in a vertical direction, said crank means having a first link mounted centrally to said shaft for rotary movement therewith and a second link freely journalled to said first link radially spaced from the center thereof and freely journalled with said presser plate whereby rotary motion of said motor is converted into linear reciprocatory motion of said presser plate.

2. The stacker mechanism, according to claim 1, where said first and,second links are oblong, said first link being secured to the drive shaft at its center and said first and second links are journalled at their ends.

3. The stacker mechanism, according to claim 1, wherein said rotary motor is unidirectional.

4. The stacker mechanism, according to claim 1, including a pair of spaced apart columns fixedly secured at one end to the top surface of said presser plate and a corresponding pair of sleeves slidably mounted over said columns, said sleeves being fixed to said housing so that on movement of said presser plate said sleeves stabilize said columns and said presser plate.

5. The stacker mechanism, according to claim 4, wherein said columns and sleeves are formed of low friction material.

6. The stacker mechanism, according to claim 4, wherein said columns and sleeves are cylindrically shaped.

* * * * *